US006302038B1

(12) United States Patent
Seo et al.

(10) Patent No.: US 6,302,038 B1
(45) Date of Patent: Oct. 16, 2001

(54) ANTI-EROSION SYSTEM OF GRATE IN STOKER-TYPE INCINERATOR

(75) Inventors: Jung Dae Seo, Koja; Se Kwang Kim, Kyoungsangnam-do; Il Sang Huh, Seoul; Sang In Keel; Seock Joon Kim, both of Taejon, all of (KR)

(73) Assignees: Daewoo Engineering and Construction Corporation; Daewoo Heavy Industries, Ltd.; Korea Institute of Machinery & Metals, all of (KR)

( * ) Notice: Subject to any disclaimer, the term of this patent is extended or adjusted under 35 U.S.C. 154(b) by 0 days.

(21) Appl. No.: 09/308,831

(22) PCT Filed: Nov. 26, 1997

(86) PCT No.: PCT/KR97/00237

§ 371 Date: May 25, 1999

§ 102(e) Date: May 25, 1999

(87) PCT Pub. No.: WO98/23899

PCT Pub. Date: Jun. 4, 1998

(30) Foreign Application Priority Data

Nov. 27, 1996 (KR) ..... 96-58250

(51) Int. Cl.[7] ..... F23H 7/14; F23H 17/00

(52) U.S. Cl. ..... 110/281; 110/328; 126/167; 126/168; 126/175; 126/152 A

(58) Field of Search ..... 110/281, 268, 110/328; 126/152 R, 174, 175, 167, 168, 152 B, 152 A

(56) References Cited

U.S. PATENT DOCUMENTS

| | | | | |
|---|---|---|---|---|
| 1,511,981 | * | 10/1924 | Riley | 110/268 |
| 2,431,799 | * | 12/1947 | Gaffney | 110/268 X |
| 3,063,696 | * | 11/1962 | Cullins | 126/168 X |
| 4,200,047 | * | 4/1980 | Knorr | 110/268 X |
| 4,569,437 | * | 2/1986 | Doerges | 110/281 X |
| 4,671,190 | * | 6/1987 | Moreau | 110/281 |
| 4,719,900 | * | 1/1988 | Martin | 110/281 X |

FOREIGN PATENT DOCUMENTS

| | | | | |
|---|---|---|---|---|
| 657 202 | | 8/1986 | (CH) . | |
| 663 266 | | 11/1987 | (CH) . | |
| 196 22 423 | | 7/1997 | (DE) . | |
| 347461 | * | 4/1931 | (GB) | 126/168 |

* cited by examiner

*Primary Examiner*—Ira S. Lazarus
*Assistant Examiner*—Ljiljana V. Ciric
(74) *Attorney, Agent, or Firm*—Akerman Senterfitt

(57) ABSTRACT

A fire grate assembly for stoker incinerators. A plurality of stationary and movable grate members are alternately arranged in the assembly. The assembly also has a preventing member, such as a liner plate, which is detachably mounted to an end of each of the movable grate members for preventing the stationary grate members and the movable grate members from directly contacting each other, while allowing the movable grate members to be linearly movable relative to the stationary grate members. The preventing member is replaceable and can have a countersunk hole, thus being adapted for bolting the end of each of the movable grate members.

3 Claims, 3 Drawing Sheets

ANTI-EROSION SYSTEM OF GRATE IN STOKER-TYPE INCINERATOR

BACKGROUND OF THE INVENTION

1. Field of the Invention

The present invention relates to, in general, a fire grate assembly for stoker incinerators, and more particularly, to a fire grate assembly capable of preventing stationary and movable grate members from coming into direct contact with each other resulting in deteriorating wear, thus allowing the grate members to be free from being changed with new ones.

2. Description of the Prior Art

As well known to those skilled in the art, conventional incinerators for burning refuse are typically classified into three types: stoker incinerators, rotary kiln incinerators and fluidized bed incinerators. The three types of incinerators are selectively used according to the kind of refuse and desired refuse treatment capacity.

Generally, stoker incinerators are preferably used for burning large amounts of municipal refuse, while fluidized bed incinerators are in the early stages of being used practically.

Such stoker incinerators are classified into various types according to both the types of fire grate assemblies and the construction of combustion furnaces. When such fire grate assemblies are designed, it is necessary to consider the installation area of a stoker incinerator, calorific power of refuse, the circulation type of combustion gas, and configuration and expected loaded conditions of the grate assembly, such as the weight of the load, because the operational functions and characteristics of such fire grate assemblies are different from each other.

FIG. 1 is a schematic view showing the construction of a conventional stoker incinerator.

As shown in FIG. 1, refuse, piled up in a refuse pit 2, is primarily measured prior to being fed into a hopper 4 by a traveling crane 3. Thereafter, the refuse of the hopper 4 are moved to the top portion of a fire grate assembly 6. The refuse is mixed with the previously burnt refuse of the grate assembly 6, thereby being dried and burnt simultaneously. In addition, the refuse, disposed at the top portion of the grate assembly 6, is gradually moved to the bottom portion of the fire grate assembly 6. Ashes, produced from the refuse completely burnt during the movement of the refuse along the grate assembly 6, are dropped into a re-treatment facility by a clinker roller 33 of FIG. 2 and are fed into an ash bunker 8.

Primary combustion air or atmospheric air, necessary for the incineration of the refuse, is forcibly intaken into the grate assembly 6 through the refuse pit 2 by a force draft fan 7, thereby preventing noxious odor from being exhausted into the atmosphere. In such a case, the intaken primary combustion air is heated by an air heater prior to being introduced into a combustion chamber of the incinerator through the fire grate assembly. The intaken air is divided into four to six sections capable of being separately controlled.

In addition, secondary combustion air, which is about 20 to 40% of the supplied air, is discharged from the side portion of the incinerator into the combustion chamber, thereby completely incinerating the incompletely burnt refuse. Combustion gas, having a high temperature and being produced from the burnt refuse, passes into a combustion. gas cooling facility and an exhaust gas treatment facility through first and second combustion chambers.

The incinerator also comprises a boiler facility 11 and an antipollution facility, including both a dust collector 13 and a stack 15. The boiler facility 11 is used for recovering heat from the combustion gas and cooling the gas, while the antipollution facility is used for removing pollutants from the combustion gas. Also, the incinerator further comprises subsidiary facilities, such as conveyer equipment for feeding, piling up and discharging dusts and ashes, a sewage treatment facility for biologically or chemically treating sewage from the incinerator, plumbing equipment for supplying water into the incinerator and draining sanitary sewage, and supply equipment for feeding compressed air and fuels, etc.

Thus, it is necessary to maintain the temperature of the combustion gas, introduced from a cooling device, lower than 300C so as to prevent the above equipment and facilities from being corroded.

FIG. 2 is a view illustrating the fire grate assembly 6 for feeding and agitating the refuse.

The grate assembly 6 comprises a plurality of uniformly-spaced stationary and movable grate members 31 and 32, which are alternately and inclinedly arranged in the assembly 6.

The movable grate members 32 push upwardly the lower portion of the refuse. However, the refuse, disposed at the top portion of the grate assembly 6, is also moved downwardly along the assembly 6 due to gravity. Therefore, the refuse is moved upwardly and downwardly, thus being effectively agitated.

The stationary grate members 31 are fixedly mounted to the incinerator, while the movable grate members 32 are movably mounted to the incinerator in such a manner that they reciprocate linearly while being in contact with the stationary grate members 31, respectively. Due to such a linear reciprocating motion of the movable grate members 32, the refuse on the fire grate assembly 6 is continuously agitated, thereby effectively improving the refuse combustion efficiency.

However, the stationary and movable grate members 31 and 32 are brought into frictional contact with each other and the movable members 32 are moved on the top surfaces of the stationary members 31. Thus, each surface of the stationary and movable grate members 31 and 31 is irregularly abraded.

Therefore, the above fire grate assembly is problematic in that the combustion pressure of the incinerator is reduced because the primary burning air, supplied to the grate assembly 6 upwardly, leaks through the gaps defined between the abraded surfaces of the grate members 31 and 32. Also, the movable grate members 32 may fail to effectively perform their linear reciprocating motion and fail to mix the refuse because the refuse is introduced into the gaps between the abraded surfaces of the grate members 31 and 32. In such a case, the refuse is incompletely burnt. As a result, poisonous gas may be generated, which is harmful to the human body.

Such abraded grate members 31 and 32 require frequent changing with new ones, thus shortening the life span of the fire grate assembly and forcing the owner to replace an existing grate assembly with a new one at excessive costs.

SUMMARY OF THE INVENTION

Accordingly, the present invention has been made with the above problems occurring in the prior art in mind, and an object of the present invention is to provide a fire grate assembly for stoker incinerators, which replaces the abraded portion of the fire grate assembly without changing the assembly with a new fire grate assembly, thereby decreasing the cost of repairs.

In order to accomplish the above object, the present invention provides a fire grate assembly for stoker incinerators, comprising a plurality of stationary and movable grate members alternately arranged in the fire grate assembly, further comprising: means for spacing the stationary grate members from the movable grate member while allowing the movable grate members to be linearly movable relative to the stationary grate members, the spacing means being detachably mounted to each of the movable grate members, thus being replaceable with a new one.

In the preferred embodiment, the spacing means comprises: a liner plate detachably mounted to an end of each of the movable grate members.

The liner plate has a countersunk hole, thus being bolted to the end of each of the movable grate members.

BRIEF DESCRIPTION OF THE DRAWINGS

The above object, and other features and advantages of the present invention will be more clearly understood from the following detailed description taken in conjunction with the accompanying drawings, in which.

DESCRIPTION OF THE PREFERRED EMBODIMENT

In the present invention, the general shape and operation of the stoker incinerator remains the same as in the prior art incinerator and further explanation is thus not deemed necessary, but the construction of a fire grate assembly included in such an incinerator is altered to easily replace an abraded liner plate of the assembly with a new one as follows.

Figure 1:
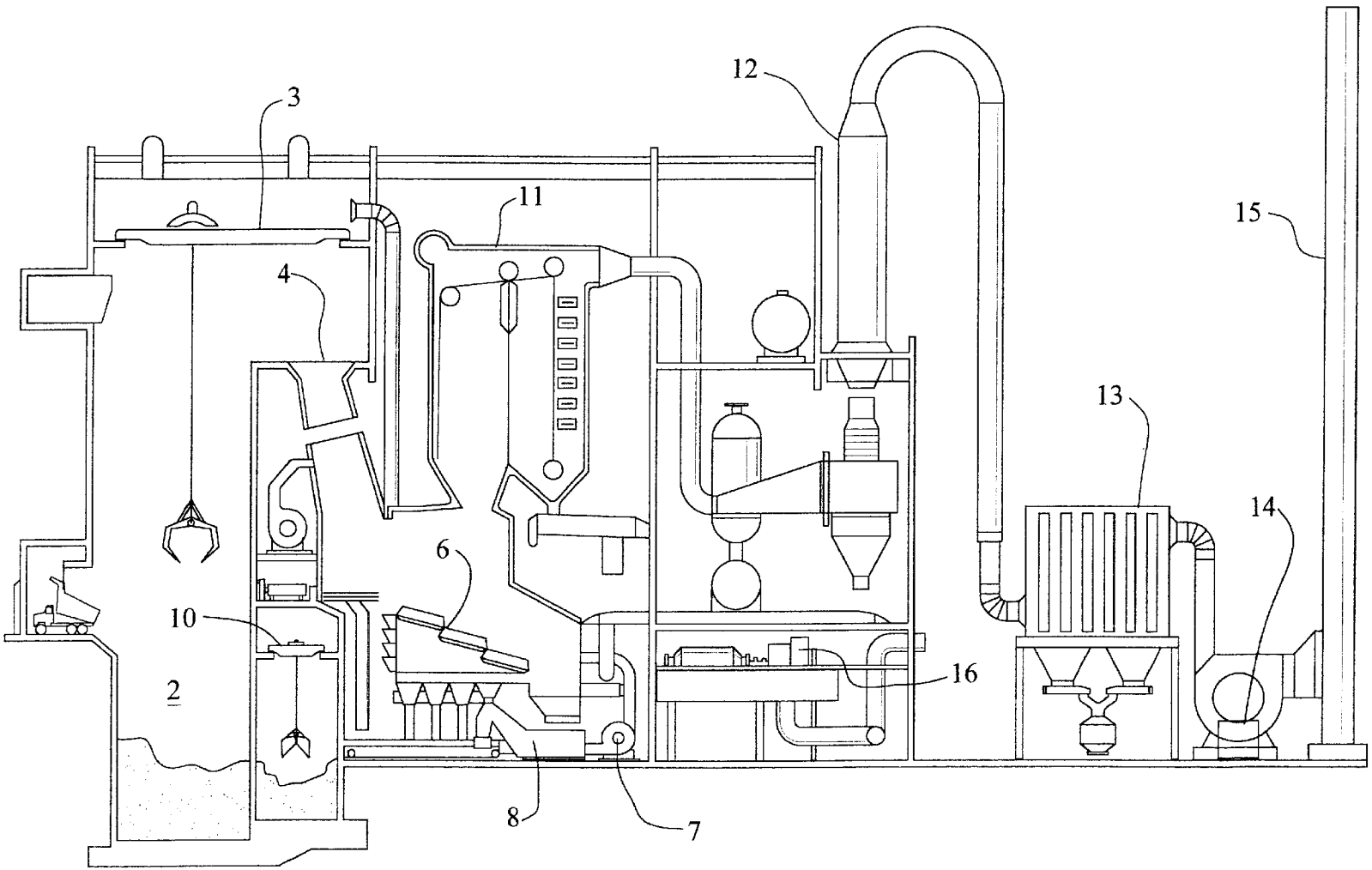
FIG. 1 is a view illustrating the construction of a conventional stoker incinerator.
Figure 2:
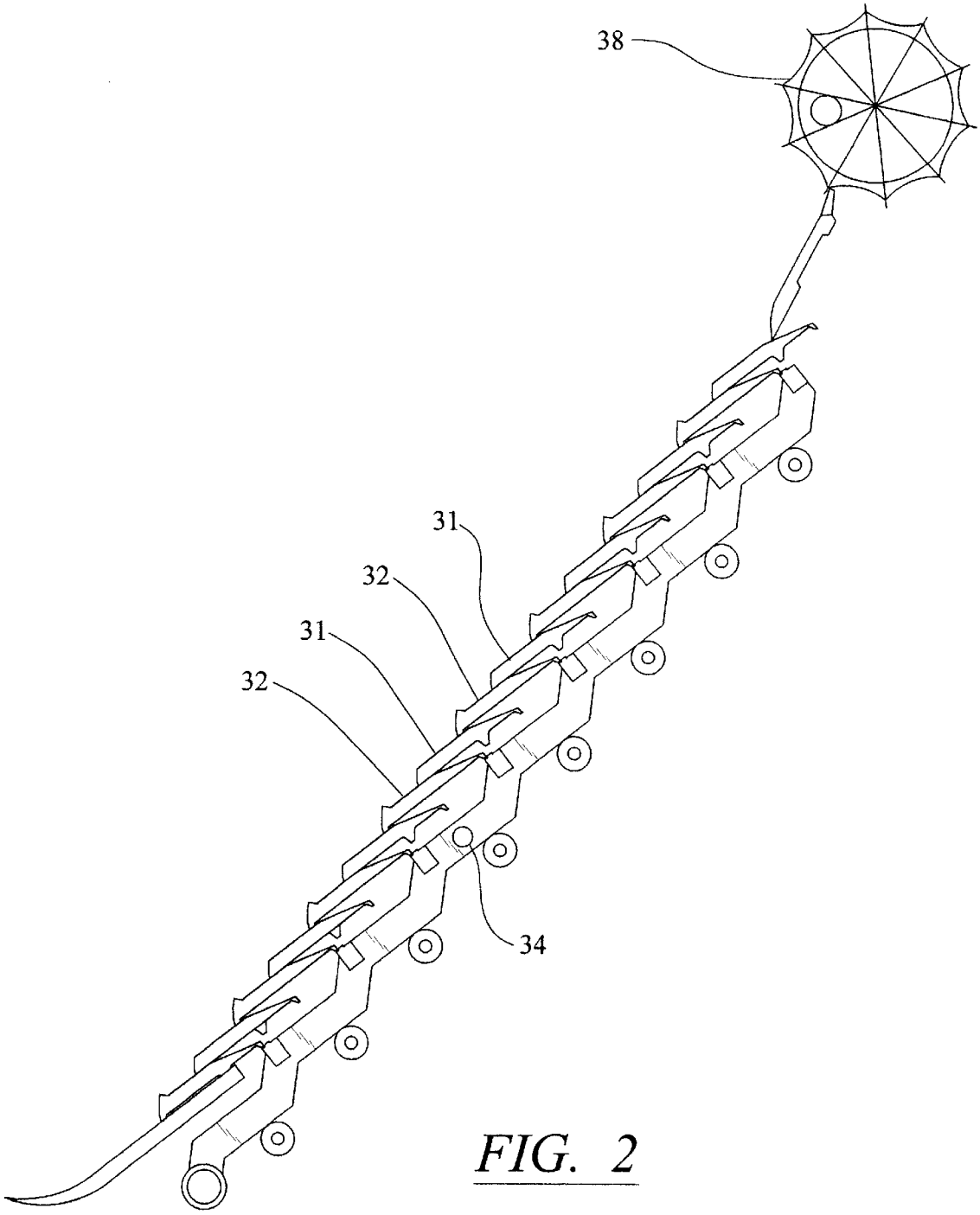
FIG. 2 is a side view of a typical fire grate assembly included in such an incinerator.
Figure 3:
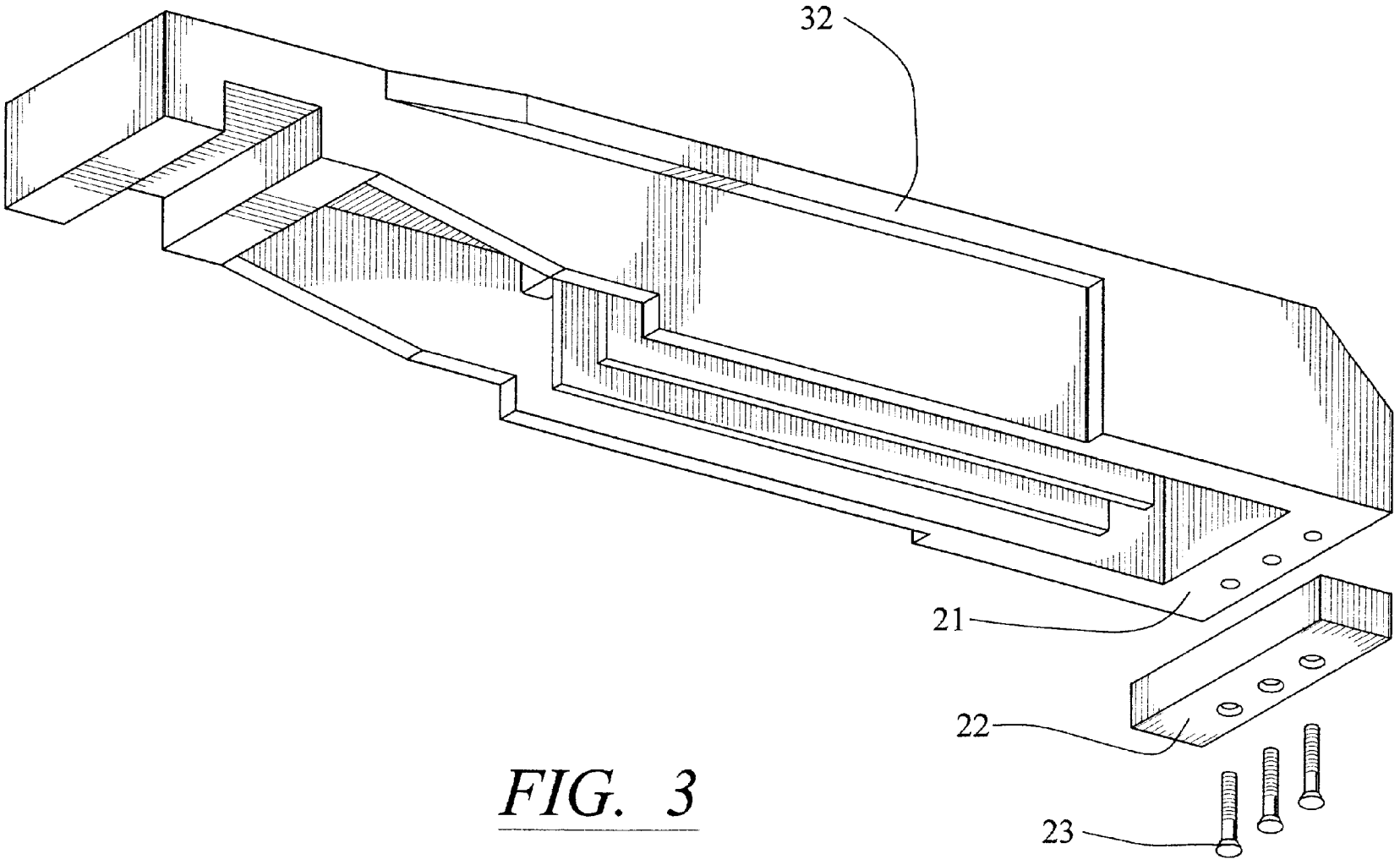
FIG. 3 is an exploded perspective view of a movable grate member of the fire grate assembly, showing the structure for selectively replacing an abraded liner plate with a new one in accordance with the preferred embodiment of the present invention.

FIG. 3 is a view illustrating the construction of a movable grate member according to the present invention.

In FIG. 3, the movable grate member 32 of this invention is turned over for easy description. Such a movable grate member 32 includes a liner plate 22 and a plurality of bolts 23. That is, the liner plate 22 is detachably mounted to the end portion 21 of the grate member 32 being in contact with a stationary grate member.

In addition, a plurality of countersunk holes are formed on the liner plate 22 so as to be bolted to the end of each of the movable grate member 32 by the bolts 23.

Thus, even when both the plate 22 and the stationary grate members are excessively abraded during the linear reciprocating motion of the movable grate member 23, the bolts 23 and movable grate 32 are free from being abraded.

As mentioned above, the fire grate assembly for stoker incinerators in accordance with the present invention is provided with a liner plate capable of preventing stationary and movable grate members from coming into direct contact with each other resulting in deteriorating wear, thereby allowing the fire grate members to be free from being, changed with new ones.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A fire grate assembly for stoker incinerators, comprising:

a plurality of stationary and movable grate members alternately arranged in the fire grate assembly;

means for preventing said stationary and movable grate members from directly contacting each other, while allowing said movable grate members to be linearly movable relative to said stationary grate members; and wherein said preventing means is detachably mounted to each of said movable grate members, said preventing means thus replaceable.

2. The fire grate assembly according to claim 1, wherein said preventing means comprises a liner plate detachably mounted to an end of each of said movable grate members.

3. The fire grate assembly according to claim 2, wherein said liner plate has a countersunk hole, thus being adapted for bolting to the end of each of said movable grate members.

* * * * *

UNITED STATES PATENT AND TRADEMARK OFFICE

CERTIFICATE OF CORRECTION

PATENT NO. : 6,302,038 B1
DATED : October 16, 2001
INVENTOR(S) : Seo et al.

It is certified that error appears in the above-identified patent and that said Letters Patent is hereby corrected as shown below:

Title page,
Item [75], Inventors, please replace "Koja" with -- Koje City --
Item [57], ABSTRACT,
Line 11, should read -- being adapted for bolting to the end of each of the movable --

Column 1,
Line 39, replace "are" with -- is --
Line 66, delete the "." before the word "gas"

Column 2,
Line 16, replace "300C" with -- 300°C --
Line 44, replace "grate members 31 and 31" with -- grate members 31 and 32 --

Column 3,
Line 10, replace "member" with -- members --

Column 4,
Line 9, replace "member" with -- members --.
Line 12, replace "grate member 23" with -- grate member 32 --
Line 13, insert the word -- member -- before "32"
Line 39, insert -- being -- before "replaceable".

Signed and Sealed this

Twentieth Day of May, 2003

JAMES E. ROGAN
*Director of the United States Patent and Trademark Office*